US005100130A

United States Patent [19]

Shoebrooks

[11] Patent Number: 5,100,130

[45] Date of Patent: Mar. 31, 1992

[54] ABDOMINAL EXERCISE DEVICE

[76] Inventor: Jeffrey D. Shoebrooks, 601 Foldstone Dr., Lexington, Ky. 40517

[21] Appl. No.: 553,743

[22] Filed: Jul. 18, 1990

[51] Int. Cl.[5] ..... A63B 23/02

[52] U.S. Cl. ..... 482/121; 482/140; 482/145

[58] Field of Search ..... 272/93, 134, 135, 144, 272/126, 136, 137, 138, 143

[56] References Cited

U.S. PATENT DOCUMENTS

| | | | |
|---|---|---|---|
| 3,117,782 | 1/1964 | Johnston | 272/134 |
| 4,307,880 | 12/1981 | Abram | 272/144 |
| 4,324,399 | 4/1982 | Ridley | 272/144 |
| 4,621,809 | 11/1986 | Pearl | 272/144 |
| 4,927,139 | 5/1990 | Taltre | 272/144 |

FOREIGN PATENT DOCUMENTS

| | | | |
|---|---|---|---|
| 112160 | 5/1956 | France | 272/144 |

*Primary Examiner*—Robert Bahr
*Attorney, Agent, or Firm*—Laubscher, Presta & Laubscher

[57] ABSTRACT

Abdominal exercise apparatus comprising a flexible and resilient board of a length extending from one end near the head portion of a user to an opposing end removed therefrom. The board is constructed to be normally flat in configuration and is bondable into an upwardly curved configuration by upward movement of a user lying thereon to contract and shorten the abdominal muscles with the user's back and head portions in engagement with the board. Handles are removably mounted on the board near the one end thereof. In use, the handles are grasped by the hands of the user during movement to contract and shorten the abdominal muscles and to bend the board upwardly into a concave configuration against the resilient force of the board. During this upward movement, the user's head, neck, shoulder, back, and buttocks portions are supported by the board. Anchoring devices are provided at or near the opposite end of the board to secure the feet, legs or thighs of user thereto. For certain abdominal exercises, the anchoring devices may be used without any handles at the one end of the board.

29 Claims, 6 Drawing Sheets

FIG. 1
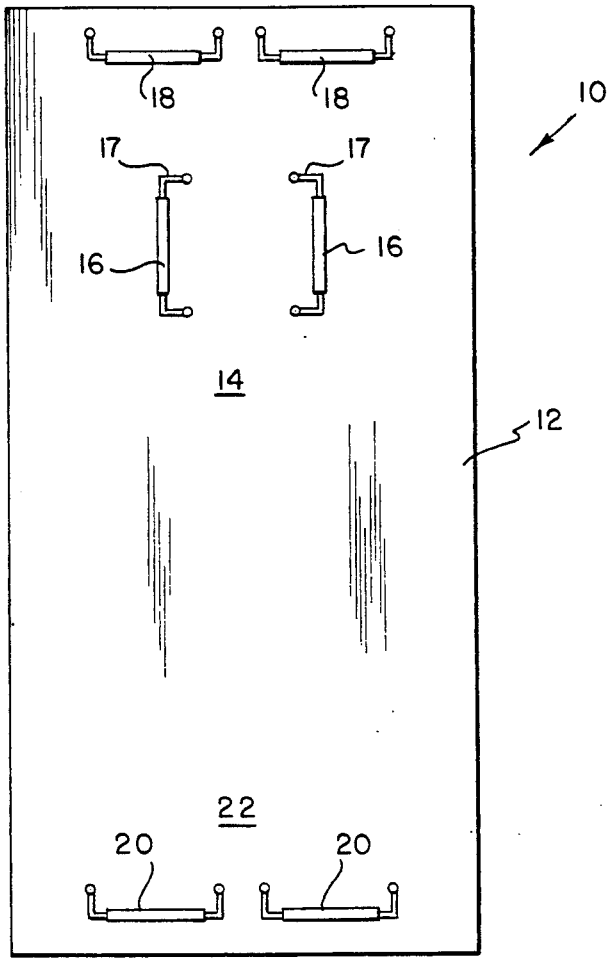
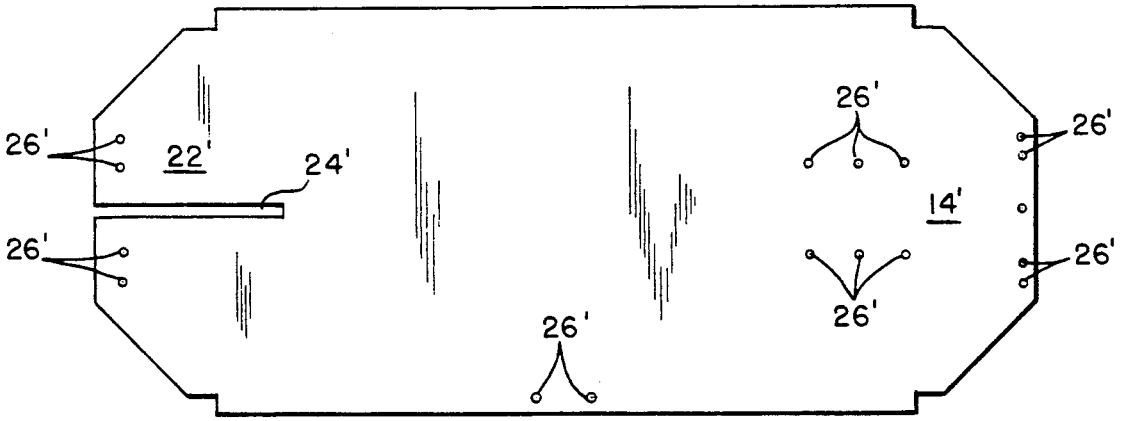
FIG. 2

FIG. 3
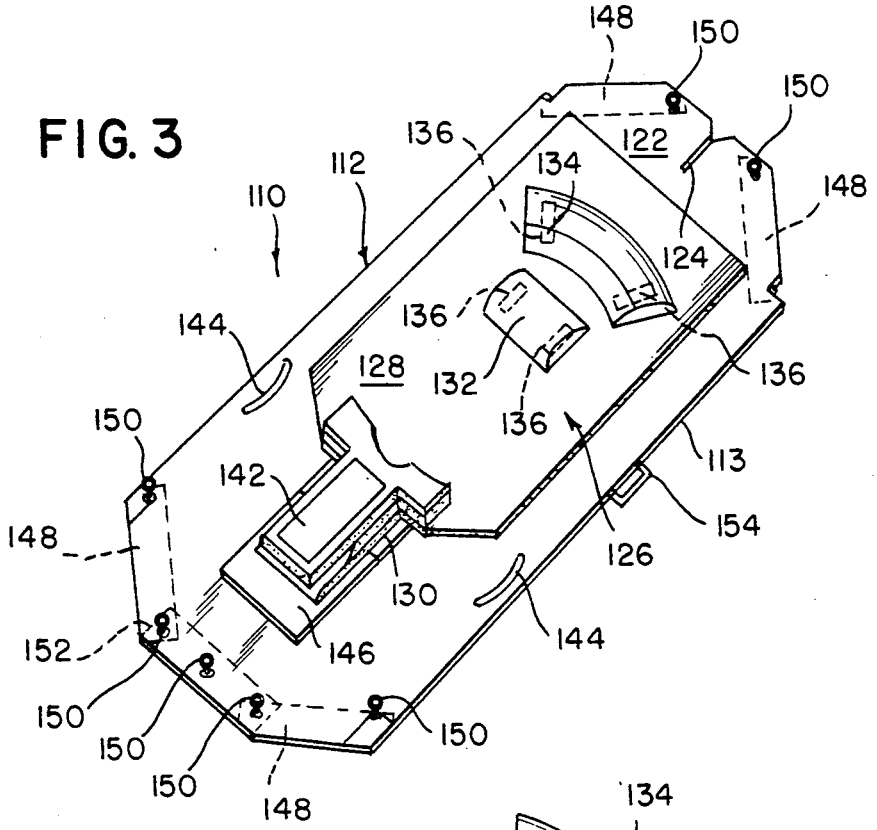
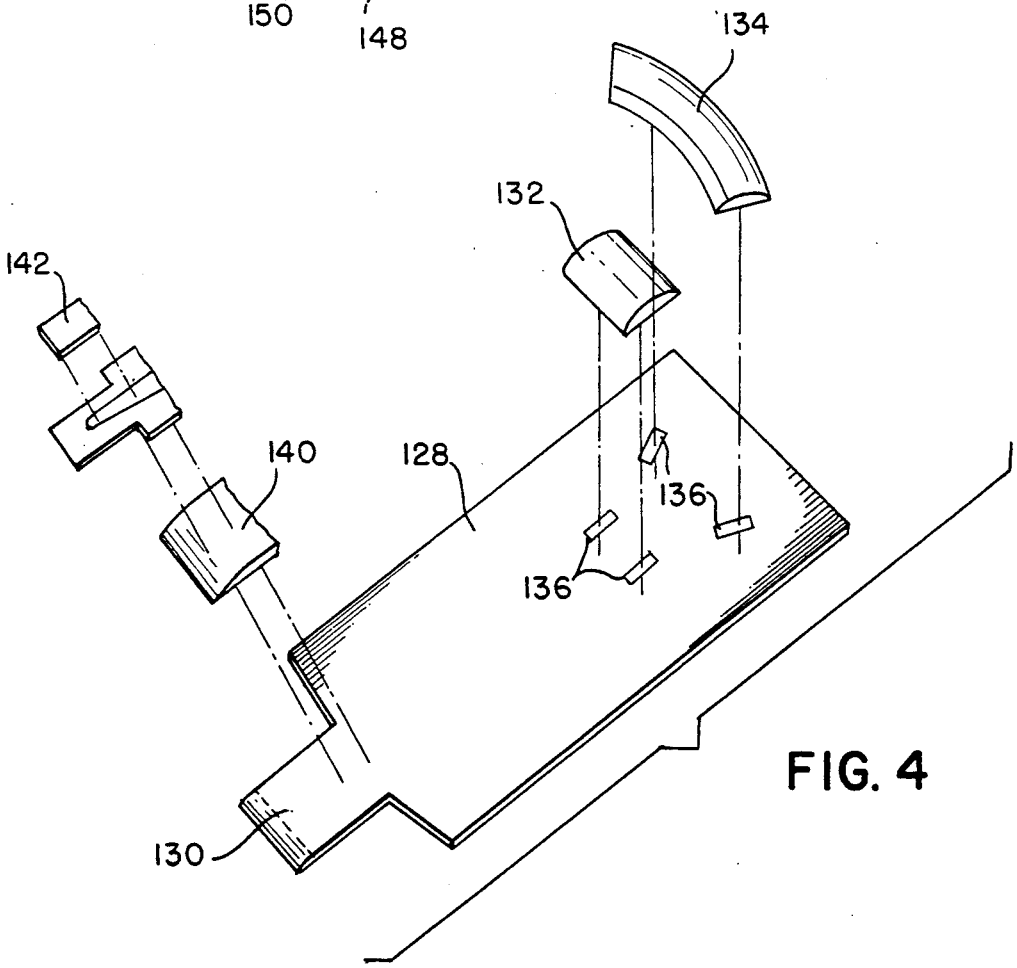
FIG. 4

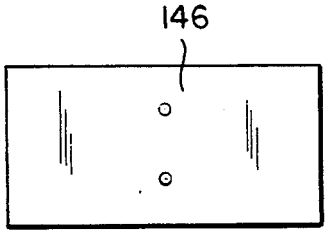
FIG. 7
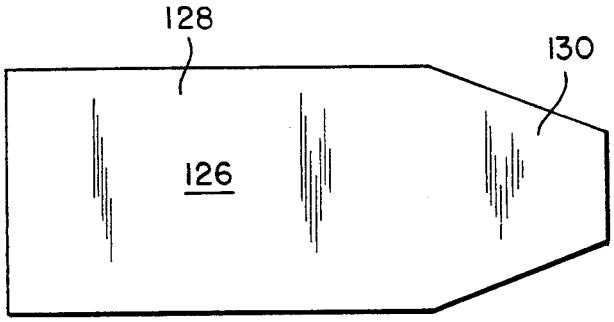
FIG. 8
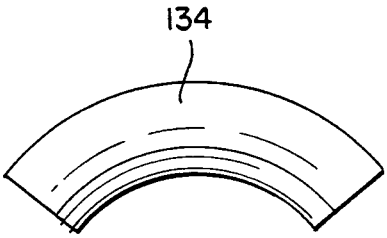
FIG. 9
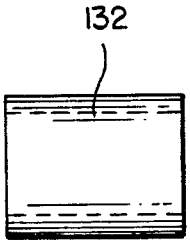
FIG. 10
FIG. 11
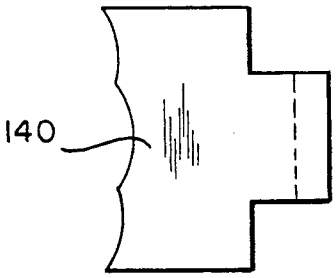
FIG. 12
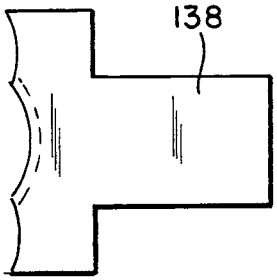
FIG. 13
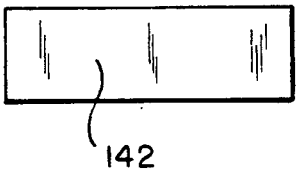

ABDOMINAL EXERCISE DEVICE

BACKGROUND—FIELD OF INVENTION

This invention relates to abdominal exercise devices, specifically to an improved device for isolating and contracting the rectus abdominis while simultaneously elevating and supporting the head during abdominal exercising so as to prevent neck fatigue or strain prior to abdominal muscular exhaustion.

BACKGROUND—DESCRIPTION OF THE PRIOR ART

Health club facilities commonly include "sit-up board" devices for isolating the abdominal muscles. Such devices to present date utilize a declining rigid horizontal board with apparatus for securing the feet.

Originally the boards were the only devices available for trunk flexion movements. The user is instructed to lie supine on the board with the feet secured and the hands interlocked behind the head. The movement consists of curling the trunk into a concave position as it is raised into a "sit up" position. Due to gravity, the head is supported by clasping the hands behind the head to aid in preventing neck fatigue.

With the help of medical science and the study of anatomy and physiology, it is known that the primary muscles used for hip flexion are the iliopsoas muscles or more commonly called "hip flexors". Because these muscles originate on the lumbar vertebrae and insert on the femurs (or thighs), many people experience lower back pain due to anterior pelvic tilting during such movements.

Several types of abdominal exercise devices have been developed to prevent pulling on the lower back vertebrae. One such device includes a molded plastic chair contoured to fit the natural curvature of the coccyx, sacral and lumbar vertebrae. The bottom of this chair has a curved "rocker arm" to make sitting up more comfortable on the user's "tail bone". The lumbosacral curvature provides added support to help raise the lower trunk of the user from a horizontal to vertical position during movement.

Another device utilizes a concave horizontal padded board for the user to lie supine. The intended purpose is to prevent the pelvis from tilting anteriorly during hip flexion movements. This device keeps the thoracic vertebrae in a concave position, thus not allowing the rib cage to elevate and thereby not permitting the rectus abdominus to lengthen as anatomically intended.

One other device incorporates a rope and pulley system. The pulley is mounted on a door knob or the like with the rope consisting of handles for the hands on one end and ankle harnesses for the feet. By lying on one's back with the head toward the pulley, the arms are pushed down from above the head to the hips. The rope then pulls the feet and legs over the chest to provide some tightening of the abdominal muscles. Like the previous device, the head remains on the ground so as not to allow the rib cage to depress, thereby not adequately shortening the rectus abdominus muscles.

Several machines have been developed that allow the user to begin in either a vertical or slightly inclined position. One machine provides a strap that is placed over the shoulders and held in the hands. After securing the feet to the floor, the trunk is then flexed forward with the head drawn toward the knees. An adjustable weight stack connected to a cable and pulley system provides negative resistance to pull the trunk back into the original inclined or vertical position. The primary muscles used for this movement are the "hip flexors" resulting in the rectus abdominus not being fully isolated.

Another weight machine is constructed so that the user is seated in a vertical position. With knees bent and feet secured by roller pads, the user then grips with the hands two handles located beside the head or slightly higher. Then by flexing the upper and lower trunk into a concave position, the user receives some resistance on the upper and lower portions of the rectus abdominus. This device is somewhat effective in isolating the rectus abdominus; however, it is very expensive to manufacture and difficult to transport due to its bulk and weight.

All of the known exercise devices suffer from one or more of the following disadvantages:

(a) The manufacturing of many prior art machines requires expensive production facilities that include welding and painting departments. Also, the weight of each machine requires that the machines must be shipped on expensive trucking carriers instead of UPS or the like. The price of such machines can run into thousands of dollars, and the weight of such machines does not allow easy portable movement. Many of these machines cannot isolate the rectus abdominus without bringing the "hip flexors" into play.

(b) The molded contoured chair device uses the "hip flexors" primarily without support of the cervical and head regions of the body.

(c) The padded contoured horizontal board keeps the thoracic vertebrae in a concave position, thus not allowing the rib cage to elevate, thereby not permitting the rectus abdominus to lengthen as anatomically intended.

(d) The rope and pulley device does not raise the head or cause the rib cage to depress, thereby not adequately shortening the rectus abdominus muscles.

(e) The declined "sit-up" slant board device primarily results in hip flexion and does not give support to the vertebral column. Owing to gravity, the neck strain can only be relieved by clasping the hands behind the head during the "sit-up" or forward flexion movements.

Accordingly, a need has arisen for abdominal exercise device which provides support for the head and neck regions of the body, isolates the rectus abdominus, is simple in construction, lightweight, portable, adjustable and inexpensive to manufacture. The new and improved abdominal exercise device of the present invention meets this need.

SUMMARY OF THE INVENTION

The abdominal exercise device of the present invention utilizes a lightweight, flexible and resilient, elongated board which preferably rests on the floor and is of a length extending from above the head portion of the user to the lower back or below the hip portion of the user. The length of the board may vary to accommodate users of different trunk lengths.

The upper portion of the board is provided with handle or gripping means secured thereto near or above the head portion of the user and positioned to be conveniently gripped by the hands of the user. Preferably, the board is constructed so that the handle means can be removably mounted in different positions thereon for users of different sizes and also to vary the difficulty of the abdominal exercise in a manner to be more specifically described hereinafter.

Generally, the present device is used for exercising the abdominal muscles by lying supine on the board and gripping the handle means near or above the user's head. The user then brings handle means forward by concentrically contracting the abdominal muscles against the resilient force of the board whereby the head portion of the board flexes upwardly into a concave configuration. During this flexing motion, the user's head, neck and upper back portions are supported by the board. The lower portion of the board may be provided with adjustable means for securing or anchoring the user's feet, legs or thighs to the board. To prevent lower back strain and maximize rectus abdominus involvement, it is preferable to keep the user's knees and thighs flexed with thighs flexed at 90° or less at the hip.

After securing or anchoring the user's feet, legs or thighs to the lower portion of the board, the user then flexes the thighs at the hip to bend the adjacent portion of the board upwardly into a concave configuration whereby a posterior pelvic tilt is created to properly position the pelvis for concentric abdominal contraction against the resilient force of the board.

To facilitate the use of the exercise board of the present invention, it may be provided with various features such as cushioning means; flexible contoured cushioned head and neck, lower back and buttock supports that are adjustably mounted thereon; means for limiting the extent to which the board may be bent; means for regulating the flexibility of the board; means for providing varying board lengths; means for facilitating the movement of the board from one location to another; reinforcing means; means for enabling handles, straps or the like to be removably or permanently secured thereto in selected positions; means for applying the board to other exercise devices; means for displaying or hanging the board; and other features, all of which are described hereinafter.

BRIEF DESCRIPTION OF THE DRAWINGS

FIG. 1 is a plan view of one embodiment of an abdominal exercise device constructed in accordance with principles of the present invention;

FIG. 2 is a plan view of a modified board or base for the abdominal exercise device of the present invention;

FIG. 3 is a perspective view of a second embodiment of the abdominal exercise device of the present invention;

FIG. 4 is an exploded, perspective view of portions of the exercise device shown in FIG. 3;

FIG. 7 is a plan view of the head platform shown in FIG. 3;

FIG. 8 is a plan view of a flexible cushioning pad for use with the exercise device shown in FIG. 3;

FIG. 9 is a plan view of the buttocks support for the exercise device of FIG. 3;

FIG. 10 is a plan view of the lower back support for the exercise device shown in FIG. 3;

FIGS. 11 and 12 are plan views of the head and neck support elements of the exercise device shown in FIG. 3;

FIG. 13 is a plan view of the cover strip for the neck support element of the exercise device shown in FIG. 3;

DESCRIPTION OF THE PREFERRED EMBODIMENTS

Figure 5:
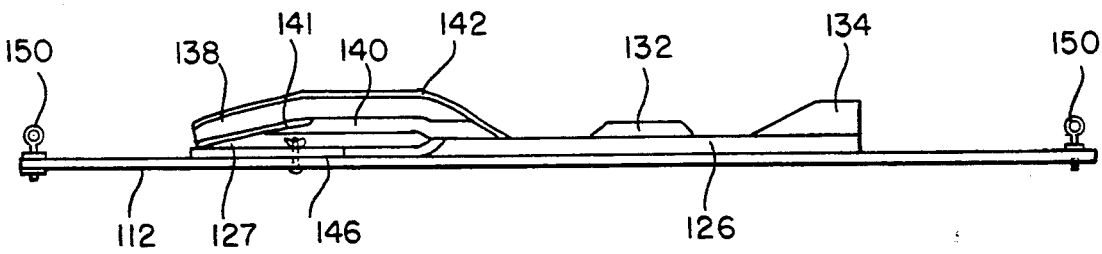
FIG. 5 is a side elevational view of the abdominal exercise device shown in FIG. 3.

FIG. 1 illustrates a first, general embodiment of the exercise device 10 of the present invention, which basically comprises a board 12 formed of any suitable flexible and resilient material. As an illustrative example, the board may preferably be approximately 3/16 inch thick and may be formed of a LEXAN® material. The board 12 may be of any desired length which preferably extends from above the head portion of a user to below the hip portion of the user. As will be further disclosed hereinafter, the board 12 may be constructed so as to be adjustable in length to accommodate users of different body lengths. Preferably, the board 12 is slightly wider than the width of the user.

The board 12 is provided near its upper end or head portion 14 with at least one pair of handles permanently or removably mounted thereon with adjustable connecting means 17 of any desired length. Also, the handles 16 may be of any suitable or desired construction.

To vary the difficulty of use of the exercise device 10, as will be more apparent from the description hereinafter, the board 12 may be provided with one or more additional pairs of handles 18 at the upper end or head portion 14 thereof. Handles 18 are permanently or removably mounted thereon with adjustable connecting means 17 and may be the same as or different from the handles 16.

To secure or anchor the user's feet, legs or thighs during abdominal exercising, the board 12 may be provided with anchoring devices 20 permanently or removably mounted thereon with adjustable connecting means 17 at the bottom end or foot portion 22 thereof. Also, the anchoring devices 20 may be made of any suitable or desired construction.

Figure 6:
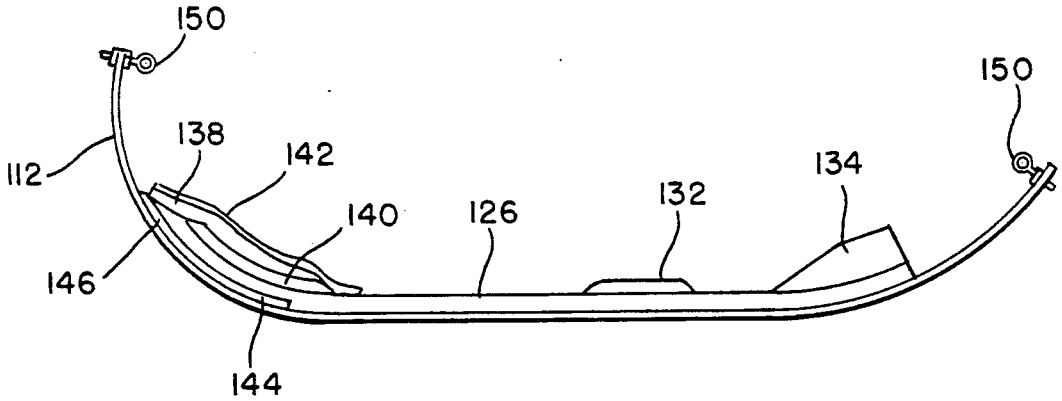
FIG. 6 is a side elevational view of the exercise device shown in FIG. 5, with the board shown in a bent position which would occur during trunk flexion of the user during abdominal contraction movement.
Figure 16A:
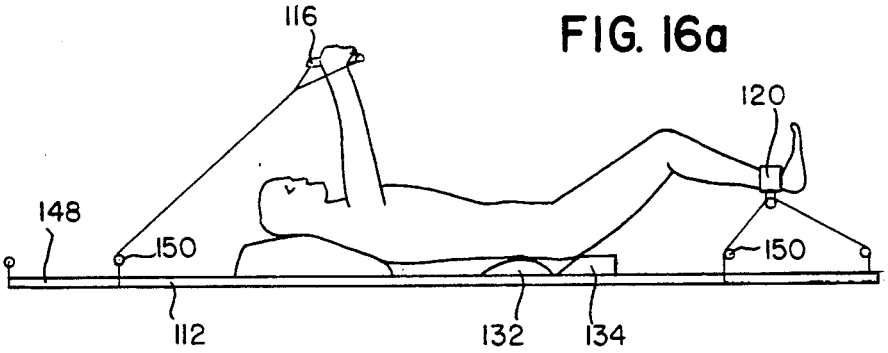
FIGS. 16*a*, 16*b* and 16*c* are side elevational views of an additional embodiment of the exercise device of the present invention, showing the user lying supine on the device with various attachment positions for securing the legs.
Figure 16B:
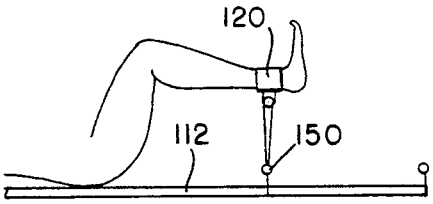
Figure 16C:
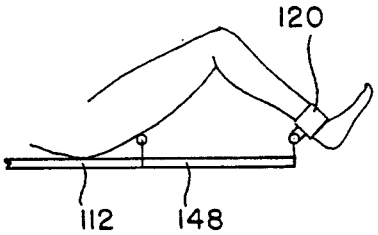

In the use of the exercise devise 10 shown in FIG. 1, the user lies supine on the board, with the user's head positioned generally between the handles 16 and the user's feet inserted into or secured to the anchoring means 20 with the knees and thighs flexed, as generally shown in FIGS. 16*a*, 16*b* and 16*c*. The user grips the handles 16 or 18 with the hands and then flexes the vertebral column while simultaneously flexing the hip to contract the abdominal muscles whereupon the head portion 14 and foot portion 22 of the board 12 bend upwardly into a concave configuration against the resilient force of the board, as generally shown in FIG. 6. The abdominal exercises are made more difficult to perform by using the handles 16 and less difficult by using the handles 18 or other handles located near the upper end of the board 12.

Because of the simple and lightweight construction of the abdominal exercise device 10, it may be easily stored and transported to different locations for use in abdominal exercises. Also, the board may be provided with any suitable type of connecting means for enabling handles, attachments or anchoring devices to be permanently or removably mounted thereon in a convenient manner, as further described hereinafter with respect to other embodiments of the present invention.

The board 12 of the present invention may be tapered at or near its end portions for the purpose of making the board more flexible at the end portions. Such a construction is shown in FIG. 2 wherein the board 12' is provided with a generally central longitudinally extending slit 24' at the foot end 22' thereof for the purpose of providing for independent flexing of the different sides of the foot end 22' of the board.

In addition, the board 12' is provided with various apertures 26' therethrough to accommodate the mounting of various devices on the board such as eyelet members for attaching connecting members 17; bolt and wing nut members for mounting a head platform thereon to vary the rigidity of the board under the head, neck, and shoulder area; locking pin means for movably securing extension members thereto for varying the length of the board; and means for securing one or more carrying handles or the like thereto.

FIG. 3 illustrates a second embodiment of the abdominal exercise device of the present invention. In this second embodiment, the exercise device 110 generally comprises a flexible and resilient board or base 112 that is the same as or similar in construction to the board 12' shown in FIG. 2. The board 112 preferably is tapered at the head end 114 and/or at the foot end 122 thereof, and has a central longitudinally extending slit 124 at the foot end thereof. For the purpose of protecting a support surface on which the board 112 is positioned, the bottom surface of the board 112 may be provided with a flexible protective pad 113. The upper surface of the bottom pad 113 could be shaped in a desired manner to cause the board secured thereto to assume a desired configuration in accordance with the human body's natural curvature.

For the purpose of facilitating the use of the abdominal exercise device 110, the board may be provided with cushioning means, head and neck support means and lower back and buttocks support means of the type shown in FIG. 3. The cushioning means may comprise a flexible base pad 126 formed of any suitable material, such as a foamed or sponge rubber, plastic or similar material, which may have liquid, air or gel provided therein for evenly distributing stress across the contact points of the user's back and shoulder areas. The base pad 126 extends generally from the foot or leg portion 122 of the board 112 to the head portion 114 of the board. The pad 126 has a wide portion 128 extending from the leg portion to an area under the user's head and neck areas. The narrow pad portion 130 may be generally rectangular in shape as shown in FIG. 3, it may be tapered as shown in FIG. 8, or it may be shaped to any other desired form (not shown). The pad 126 may be permanently affixed or removably mounted on the board 112 in any suitable manner, such as by adhesive or VELCRO® hook and loop type material (not shown).

The lumbosacral support means preferably comprise a lower back support element 132 and a curved, wedge-type buttocks support 134 which is spaced from the lower back support element 132 toward the foot or leg portion 122 of the board 112. The lower back and buttocks support elements 132, 134 may be formed of any suitable flexible, cushioned and resilient material, such as a foamed or sponge rubber, plastic or similar material, which may have liquid, air or gel provided therein for evenly distributing stress across the contact points of the user's lower back area and buttocks. VELCRO® hook and loop type material 136 may be used for removably securing the lower back and buttocks support elements 132, 134. Alternatively, the bottom of the support elements may have pins for inserting into various holes (not shown) in the pad 126 or the board 112 to allow easy length adjustment. As an additional embodiment, the lower back support element 132 and the buttocks support element 134 may be formed in one piece (not shown). Also, the buttocks support element 134 can be used independently from the lower back support element 132 or vice versa.

The head and neck support means generally comprise a pair of T-shaped flexible, cushioned and resilient pads 138 and 140 which may be formed of any suitable materials such as those used for the lower back and buttock support elements 132, 134. As shown in FIG. 3, the neck and head support pads 138 and 140 have the wider portions thereof positioned near the shoulder area of the user, and the narrower portions thereof extend toward the adjacent end of the board under the neck and head areas of the user. The lower pad 140 is shorter than the upper pad 138 for the purpose of providing additional or thicker support under the neck area of the user and thinner support under the head area of the user. As shown in FIGS. 3–6, the base pad 126 and lower support pad 140 preferably have adjacent tip wedge cut ends 127 and 141, respectively, so to provide a smooth, tapered, reduced thickness support for the upper pad 138 in the head area to facilitate movement of the head. The neck and head support pads 138, 140 may be permanently or removably secured to the base pad 126 in any suitable manner, such as by adhesive or VELCRO® hook and loop material. In addition, the neck and head support pads 138, 140 may be formed in a one-piece configuration (not shown).

For the purpose of maintaining the cleanliness of the neck and head support pad 138 and also providing for easy sliding movement of the rear portion of the user's head thereover, a cover 142 may be removably mounted in any suitable manner over the pad 138. The cover 142 may encircle the neck and head support pad 138 (not shown) and may be formed of any suitable material such as vinyl, plastic, nylon or the like.

In order to minimize the possibility of excessive vertebral flexion, it is important to limit the degree of neck and upper back flexion of the user during abdominal exercising. For this purpose, the board 112 of the present invention is provided with a pair of curved safety bars 144 on opposite sides thereof for the purpose of limiting amount of upward curvature of the head portion 114 of the board 112. The safety bars 144 may be adjustably secured to the board 112 in any suitable manner, such as by screws or the like.

To vary the difficulty of the abdominal exercise and/or to regulate the flexibility of the head portion 114 of the board 112, a head platform 146 may be removably mounted on the board 112 in the head, neck and shoulder area thereof. The head platform 146 may be of any desired thickness and size, and may be mounted in different positions on the board 112 to vary the location of the curvature and degree of bending of the board during abdominal exercise. For example, the head platform may be located to allow the board to lift mostly the user's head or to lift both the shoulders and head of the user during use. Also, a longer head platform will make the board harder to bend and thus make the abdominal exercise more difficult.

For the purpose of accommodating users of different heights or sizes, the head and/or foot ends of the board 112 may be provided with extension members 148 that are pivotally mounted thereon for movement between storage positions shown in FIG. 3 and the extended positions shown generally in FIG. 16*a*. The extension members 148 may be of any suitable construction and may be mounted on the board 112 in any suitable manner, such as by nuts and bolts or the like.

As shown in FIG. 3 the board 112 is provided with a plurality of eyelet or screw members 150 or the like removably or permanently mounted thereon for the purpose of providing a means of attaching connecting members 17 with the handle members 116 and anchoring members 120 for the feet, legs or thighs of the user in the manner generally shown in FIG. 16*a*. The eyelet members 150 are also provided on the extension members 148 so that the connecting members can be secured to the extension members when they are in use.

As a further feature, the head end of the board 112 may be provided with a header or reinforcing member 152 secured thereto, and one or more handles 154 for the purpose of facilitating the transport of the abdominal exercise device 110 from one location to another.

In the use of the abdominal exercise device of FIG. 3, the user lies with his or her back on the board 112 in the manner generally shown in FIG. 16*a*, with the user's head, neck, lower back and buttocks portions properly supported on the head and neck support pads 138, 140, the lower back support 132 and the buttocks support 134, respectively. With the user's feet, legs or thighs properly anchored by the anchoring members 120 and the knees and thighs flexed in a manner the same as or similar to that shown in FIGS. 16*a*, 16*b* and 16*c*, the user then grips appropriate handles 116 secured to the head portion of the board and raises his or her shoulders to bend the adjacent portion of the board upwardly into a concave configuration to contract the abdominal muscles against the resilient force of the board and the selected head platform 146 secured thereto. During this raising or "crunching" motion, the user's head, neck and back regions are adequately supported by the board to thus prevent any back or neck strain during the abdominal exercises. For the purpose of limiting the flexion of the neck, the angle of curvature through which the head portion of the board may be bent is controlled by the safety bars 144. Accordingly, with the use of the exercise device 110, the user can effectively and safely exercise and strengthen the appropriate abdominal muscles. Because of the extension members 148, the exercise device 110 can be conveniently used by users of different trunk and limb lengths.

Figure 14:
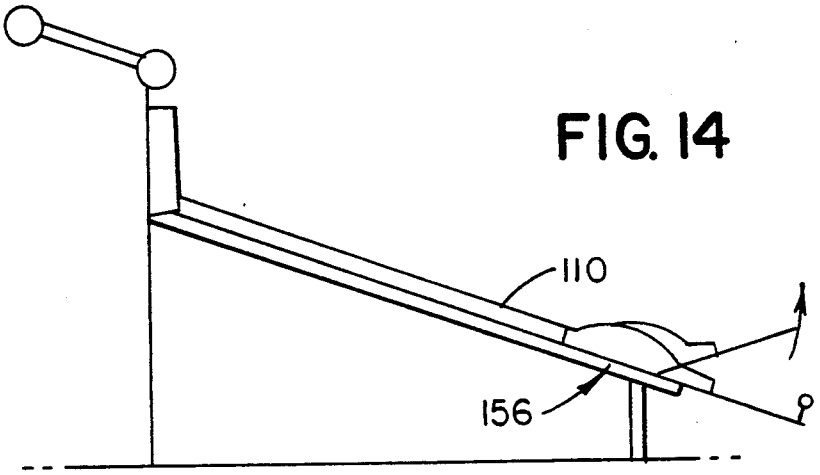
FIG. 14 is a side elevational view of an additional embodiment of the exercise device of the present invention, showing use of the exercise device mounted on a declined abdominal exercise bench.
Figure 15:
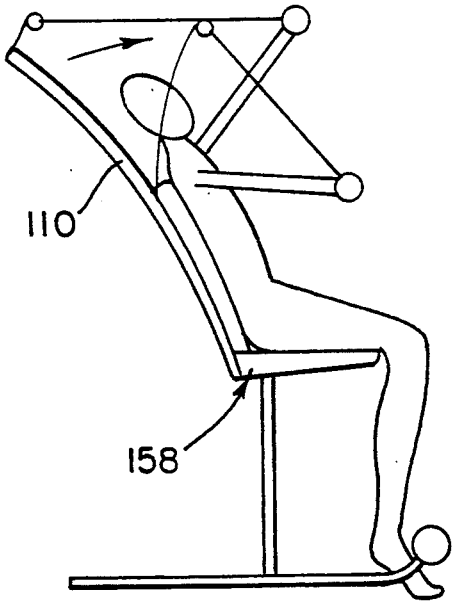
FIG. 15 is a side elevational view of a further embodiment of the exercise device of the present invention, showing it mounted on an inclined seat-type abdominal exercise device.

In addition to being placed on the floor or a similar horizontal support surface, the exercise devices 10 or 110 of the present invention could be mounted on an inclined abdominal exercise bench 156, as generally shown in FIG. 14, or could be mounted on any vertical support or inclined abdominal exercise seat-type device 158, as generally shown in FIG. 15.

Figure 17:
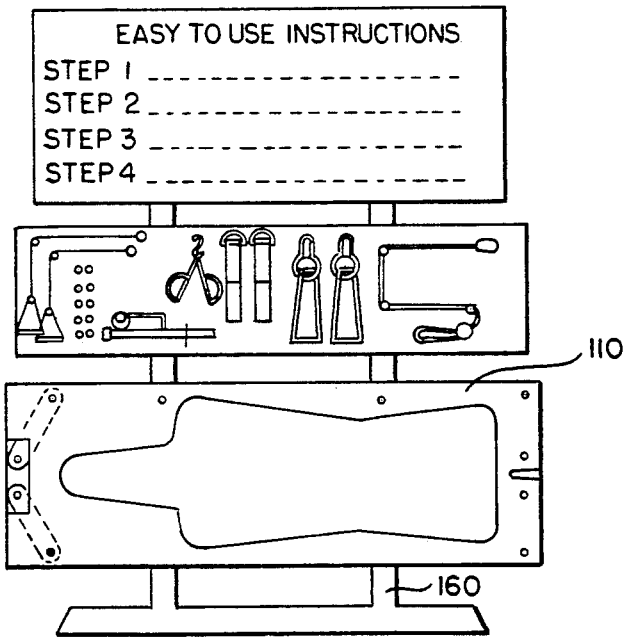
FIG. 17 is a side elevational view of a display apparatus with the exercise device of the present invention and various accessories therefor removably mounted thereon.

Referring to FIG. 17, because of the portability of the exercise device 110 of the present invention, it may be conveniently stored on a display rack 160 or the like, along with various types of handles for use with the exercise device and a set of instructions for use of the device.

As a further embodiment of the invention, the board (such as board 12 or board 122) could be provided with anchoring means of any suitable type near one end thereof for anchoring the feet, legs or thighs of the user. Without the use of handle means or the like near the head or other end of the board, the user, in a supine position with his or her feet, legs or thighs anchored to the boards, draws the knees toward the chest in a hip flexion movement to tilt the pelvis posteriorly to contract the lower abdominal muscles and to bend the one end of the board upwardly into a concave configuration against the resilient force of the board. In this embodiment, the board preferably is of a length such that the other end thereof extends under the neck or shoulder area of the user.

Within the scope of the present invention, it is noted that various modifications may be made to the construction or shape of the board, cushioning means, head platform support means, and handle means of the abdominal exercise device, as well as the materials used for these means.

What is claimed is:

1. Abdominal exercise apparatus, comprising:

a flexible and resilient elongated board of a length extending from one end near the head portion of a user to an opposite end spaced therefrom and extending at least to the lower back portion of the user, said board being constructed to be normally flat in configuration and being bendable into an upwardly curved configuration by movement of a user lying in a supine position thereon to contract and shorten the abdominal muscles with the user's back and head portions in engagement with said board; and handle means mounted on said board near said one end thereof, said handle means being positioned on said board within the frame of said board near and on opposite sides of the head portion of a user lying in a supine position thereon so that gripping of said handle means by the hands of the user while in the supine position and said movement of the user bends said board upwardly into a concave configuration to contract and shorten the abdominal muscles against the resilient force of said board, while the user's head, neck, shoulder and back portions are supported by said board.

2. The apparatus of claim 1 wherein said handle means are removably mounted on said board.

3. The apparatus of claim 1 wherein said board is constructed to removably support handles in different positions near said one end thereof.

4. The apparatus of claim 1 wherein means are provided on said board for securing the feet, legs or thighs of the user to said board near said opposite end thereof.

5. The apparatus of claim 4 wherein said board has a plurality of apertures therethrough for the removable mounting thereon of said handle means and said securing means.

6. The apparatus of claim 1 wherein said one end of said board is tapered inwardly to increase the flexibility thereof.

7. The apparatus of claim 6 wherein said opposite end of said board has a substantially longitudinal slit therethrough for independent flexing of the portions thereof on opposite sides of said slit.

8. The apparatus of claim 1 wherein a flexible pad is mounted on the upper surface of said board to provide flexible and cushioned support of the user's head, neck, shoulder, back, and buttocks portions.

9. The apparatus of claim 8 wherein additional flexible neck and head support means are mounted on said board near said one end thereof.

10. The apparatus of claim 9 wherein further flexible support means are mounted on said board for the support of the lower back and buttocks portions of the user.

11. The apparatus of claim 10 wherein said lower back and buttocks support means are removably mounted on said board.

12. The apparatus of claim 9 wherein said additional neck and head support means are removably mounted on said board.

13. The apparatus of claim 12, wherein a cover is removably disposed over said additional neck and head support means.

14. The apparatus of claim 1 wherein means are mounted on said board for limiting the amount of upward and forward bending thereof in response to movement of the user.

15. The apparatus of claim 14 wherein said limiting means comprise a pair of curved safety bars mounted on opposite sides of said board.

16. The apparatus of claim 1 wherein means are removably mounted on said board near said one end thereof for varying the amount of flexibility of said one end.

17. The apparatus of claim 16 wherein said flexibility varying means comprises a head platform secured to said board near the head, neck and shoulder portions of the user.

18. The apparatus of claim 1 wherein said board comprises means for facilitating the transport and display of said board.

19. The apparatus of claim 1 wherein means are provided for adjusting the length of said board.

20. The apparatus of claim 1 wherein a flexible pad is provided on the lower surface of said board.

21. Abdominal exercise apparatus, comprising:

a flexible and resilient elongated board of a length extending from a first end near the legs of a user to a second end spaced therefrom and extending at least to the upper back portion of the user, said board being constructed to be normally flat in configuration and being bendable into an upwardly curved configuration by movement of a user lying in a supine position thereon to contract and shorten the abdominal muscles with user's back and shoulder portions in engagement with said board; and anchoring means mounted on said board near said first end thereof, said anchoring means being positioned on said board within the frame of said board near the feet, legs or thighs of a user lying a supine position thereon to engage and anchor the feet, legs or thighs of the user to the board, whereby movement of the user's knees toward the chest in a hip flexion movement, while in the supine position and with the feet, legs or thighs anchored to said board, bends said first end of said board upwardly into a concave configuration to contract the lower abdominal muscles against the resilient force of said board, while the user's back and buttocks are supported by said board.

22. The apparatus of claim 21 wherein said anchoring means are removably mounted on said board.

23. The apparatus of claim 22 wherein said board has a plurality of apertures therethrough for the mounting of said anchoring means thereon.

24. The apparatus of claim 21 wherein a flexible pad is mounted on the upper surface of said board to provide flexible and cushioned support of the user's head, neck, shoulder, back, lower back and buttocks portions.

25. The apparatus of claim 24 wherein additional flexible neck and head support means are mounted on said board near said second end thereof.

26. The apparatus of claim 25 wherein further flexible support means are mounted on said board for the support of the lumbar and sacral portions of the user.

27. The apparatus of claim 26 wherein said lower back and buttocks support means are removably mounted on said board.

28. The apparatus of claim 21 wherein said board comprises means for facilitating the transport and display of said board.

29. The apparatus of claim 21 wherein means are provided for adjusting the length of said board.

* * * * *